US010883792B1

(12) United States Patent
McCarthy

(10) Patent No.: US 10,883,792 B1
(45) Date of Patent: Jan. 5, 2021

(54) METHOD OF MICRO ADJUSTING CAM TIMING AND CAM ORIENTATION ON AN ARCHERY BOW

(71) Applicant: Daniel W. McCarthy, Gays Mills, WI (US)

(72) Inventor: Daniel W. McCarthy, Gays Mills, WI (US)

(73) Assignee: Randy Kitts, Ball Ground, GA (US)

( * ) Notice: Subject to any disclaimer, the term of this patent is extended or adjusted under 35 U.S.C. 154(b) by 0 days.

(21) Appl. No.: 16/872,569

(22) Filed: May 12, 2020

Related U.S. Application Data

(60) Provisional application No. 62/855,015, filed on May 31, 2019.

(51) Int. Cl.
*F41B 5/14* (2006.01)
*F41B 5/10* (2006.01)

(52) U.S. Cl.
CPC ..... *F41B 5/148* (2013.01); *F41B 5/105* (2013.01); *F41B 5/1411* (2013.01)

(58) Field of Classification Search
CPC ..... F41B 5/14; F41B 5/1403; F41B 5/1419; F41B 5/1407; F41B 5/1411; F41B 5/148
USPC ..... 124/86, 87, 90, 92
See application file for complete search history.

(56) References Cited

U.S. PATENT DOCUMENTS 3,199,502 A * 8/1965 Stonecipher ..... F41G 1/467 124/87
3,410,644 A * 11/1968 McLendon ..... F41G 1/467 356/247
3,612,029 A * 10/1971 Carroll ..... F41B 5/1407 124/92
3,942,507 A * 3/1976 Opal ..... F41B 5/1411 124/87
4,011,853 A * 3/1977 Fletcher ..... F41G 1/467 124/87
4,563,821 A * 1/1986 Saunders ..... F41B 5/1419 33/265
4,656,747 A * 4/1987 Troncoso ..... F41G 1/467 124/87
4,895,129 A * 1/1990 Hedgpeth ..... F41B 5/1419 124/87
5,325,598 A * 7/1994 Hall ..... F41B 5/1419 33/265
5,347,976 A * 9/1994 Saunders ..... F41G 1/467 124/87

(Continued)

*Primary Examiner* — Alexander R Niconovich
(74) *Attorney, Agent, or Firm* — Donald J. Ersler

(57) ABSTRACT

A method of micro adjusting cam timing on an archery bow includes separating filaments of a cable or bow string to form a split area and inserting an adjustment spacer into the split area. The adjustment spacer causes a length of a bow string or cable to be shortened. The split in the cable or bowstring requires moving the limbs toward each other to allow the filaments of a cable or bowstring to be separated for insertion of the adjustment spacer. However, the cable or bow string may be sold with a pre-inserted split holder to allow the adjustment spacer to be inserted into the bow string without the need for a bow press. The adjustment spacer includes a middle perimeter, which tapers outward in opposing directions to a larger retention perimeter. The split holder is preferably a thin disc with a plurality of notches formed around a perimeter thereof.

9 Claims, 3 Drawing Sheets

(56) References Cited

U.S. PATENT DOCUMENTS

| | | | | | |
|---|---|---|---|---|---|
| 5,542,186 | A * | 8/1996 | Saunders | F41B 5/1419 | 33/265 |
| 5,669,146 | A * | 9/1997 | Beutler | F41B 5/1419 | 33/265 |
| 5,676,123 | A * | 10/1997 | McPherson | F41B 5/14 | 124/90 |
| 6,237,584 | B1 * | 5/2001 | Sims | F41B 5/1407 | 124/92 |
| 6,679,242 | B1 * | 1/2004 | Martin | F41B 5/1426 | 124/90 |
| 6,839,994 | B2 * | 1/2005 | Proctor | G09F 3/005 | 124/90 |
| 7,040,027 | B1 * | 5/2006 | Shaffer | F41B 5/1419 | 33/265 |
| 7,543,389 | B2 * | 6/2009 | Grace, Jr. | F41B 5/1419 | 33/265 |
| 8,281,777 | B2 * | 10/2012 | Bach | F41G 1/467 | 124/87 |
| 10,161,708 | B1 * | 12/2018 | Ady | F41B 5/1419 | |
| 10,345,072 | B1 * | 7/2019 | Webster | F41B 5/1407 | |
| 10,359,252 | B2 * | 7/2019 | Ady | F41B 5/1411 | |
| 2013/0306046 | A1 * | 11/2013 | Ady | F41B 5/1411 | 124/25.6 |

* cited by examiner

METHOD OF MICRO ADJUSTING CAM TIMING AND CAM ORIENTATION ON AN ARCHERY BOW

CROSS-REFERENCE TO RELATED APPLICATIONS

This is a nonprovisional patent application, which claims the benefit of provisional patent application No. 62/855,015 filed on May 31, 2019.

BACKGROUND OF THE INVENTION

Field of the Invention

The present invention relates generally to archery and more specifically to a method of micro adjusting cam timing and cam orientation on an archery bow, which utilizes separating filaments of a cable or a bowstring to insert of an adjustment spacer into the split area.

Discussion of the Prior Art

It appears that the prior art does not teach or suggest a method of micro adjusting cam timing and cam orientation on an archery bow by separating filaments of a cable or bowstring and inserting an adjusting spacer into a split area in the cable or the bowstring. Accurate arrow shots require that both cams in a two cam system hit a rotation stop at precisely the same time. Otherwise, release force in each cam will not be equal. However, increasing accuracy of arrow shots is not limited to archery bows with a two cam system, but should include any type of cam setup, such as twin cams, single cams, solo cams, hybrid cams, and binary cams. The cable lengths of other cam setups also need to have the length of the cable and/or bowstring adjusted precisely, so that the cam will be orientated in a manner in which it's draw stop properly and precisely stops the cam in an orientated location that the cam was intended to stop at by the manufacture.

Accordingly, there is a clearly felt need in the art for a method of micro adjusting cam timing and cam orientation on an archery bow, which utilizes separating filaments of a cable or a bowstring to insert an adjustment spacer into a split area, or providing a cable or bowstring with a split holder pre-inserted into a split area for facilitating the later insertion of the adjustment spacer.

SUMMARY OF THE INVENTION

The present invention provides a method of micro adjusting cam timing and cam orientation on an archery bow, which provides a cable or bowstring with a split holder inserted into a split area for facilitating the later insertion of an adjustment spacer. The method of micro adjusting cam timing and cam orientation on an archery bow (micro adjusting method) preferably includes separating filaments of a cable or bowstring to form a split area and inserting an adjustment spacer into the split area. Insertion of the adjustment spacer into the bowstring or cable causes a length of the bowstring or cable to be shortened. When the adjustment spacer is retained in a cable it enables the bowstring to have an increased draw length.

The split area in the cable or bowstring requires compressing the limbs with any suitable method, such as a bow press to release tension of the filaments of the cable or bowstring to be separated to allow insertion of the adjustment spacer. However, the cable or bowstring may be sold with a pre-inserted split holder to allow the adjustment spacer to be inserted into the bow string without the need for a bow press. The split holder is capable of being moved up or down the cable or bowstring to create a split area in any part of a length of the cable or bowstring. The adjustment spacer preferably includes a middle perimeter, which tapers outward in opposing directions to a larger retention perimeter. The adjustable spacer may be fabricated from any suitable material, such as a plastic, a metal, rope, wood or any combination of materials. The split holder preferably includes a middle perimeter, which tapers outward in opposing directions to a larger retention perimeter, but is larger than the adjustment spacer. The split holder may be fabricated from any suitable material, such as a plastic, rope, a metal, wood or any combination of materials.

These and additional objects, advantages, features and benefits of the present invention will become apparent from the following specification.

DETAILED DESCRIPTION OF THE PREFERRED EMBODIMENTS

Figure 1:
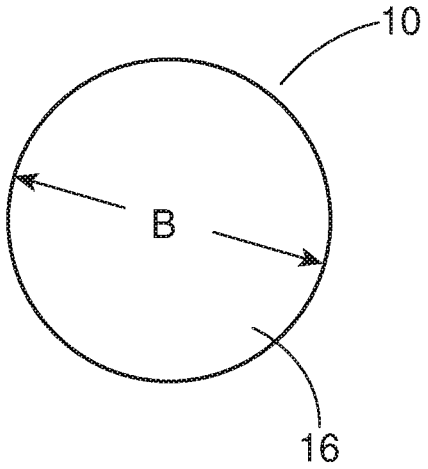
FIG. 1 is an end view of an adjustment spacer or split holder of a micro adjusting method in accordance with the present invention.
Figure 2:
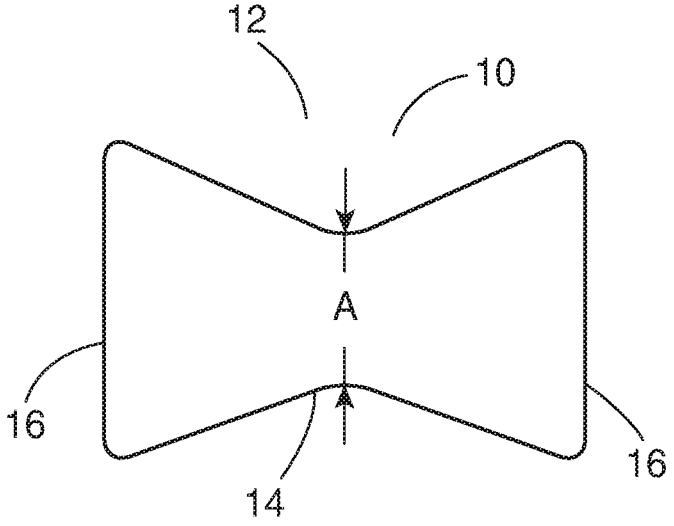
FIG. 2 is a side view of an adjustment spacer or a split holder of a micro adjusting method in accordance with the present invention.
Figure 3:
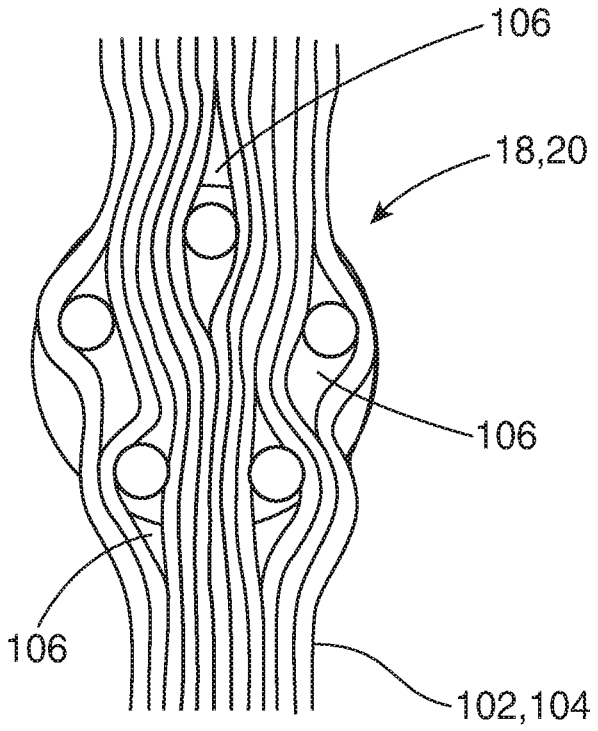
FIG. 3 is an end view of an adjustment spacer or split holder with multiple separation projections creating multiple split areas in a cable or bowstring of a micro adjusting method in accordance with the present invention.

With reference now to the drawings, and particularly to FIGS. 1-2, there is shown an adjustment spacer 10 or a split holder 12. With reference to FIG. 3, a micro adjusting method preferably includes separating filaments 103 of a cable 102 or bowstring 104 to form a split area 106 and inserting the adjustment spacer 10 into the split area 106. The adjustment spacer 10 causes a length of a bowstring 104 or a cable 102 to be shortened. When the adjustment spacer 10 is retained in the cable 102 it enables the bowstring 104 to have an increased draw length. The split area 106 in the cable 102 or bowstring 104 requires compressing limbs 108 of an archery bow 100 with any suitable method, such as a bow press to release tension of the filaments 103 of the cable 102 or bowstring 104 to be separated to allow insertion of the adjustment spacer 10 or split holder 12.

The cable 102 or bowstring 104 may be sold with a split holder 12 to allow the adjustment spacer 10 to be inserted into the split area 106 of the cable 102 or bowstring 104 without the need for compressing the limbs 108. However, the split holder 12 could be inserted between filaments of the cable 102 or bowstring 104 while the cable 102 or bowstring 104 is being constructed. The split holder 12 is moved up or down the cable 102 or bowstring 104 to create the split area 106 in any part of a length of the cable 102 or bowstring 104. The adjustment spacer 10 and the split holder 12 preferably include a middle perimeter 14, which tapers outward in opposing directions to a larger retention perimeter 16. A shortened length of the cable 102 or bowstring 104 is proportional to a length of the middle perimeter 14. However, other designs of the adjustment spacer 10 and split holder 12 may also be used. Alternatively, the adjustment spacer 10 and the split holder 12 could be the shape of a rod fabricated from material, which is soft enough to compress when pressure is applied by the plurality of filaments of the cable 102 or bowstring 104, such as rubber or wood.

The following dimensions are given by way of example and not by way of limitation. It is preferable that dimension A have a range of between 0.005-0.5 inches. It is preferable that dimension B have a range of between 0.25-1.0 inches. However, other dimensions may also be used. The adjustable spacer 10 and the split holder 12 may be fabricated from any suitable material, such as a plastic, a metal, a rope, wood or any combination of materials. The adjustable spacer 10 and the split holder 12 are retained in the cable 102 or bowstring 104 by axial tension of the cable 102 or bowstring 104.

Figure 4:
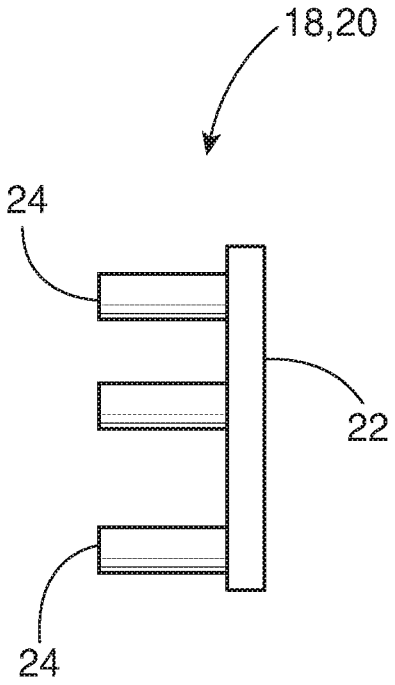
FIG. 4 is a side view of an adjustment spacer or split holder with multiple separation projections of a micro adjusting method in accordance with the present invention.
Figure 5:
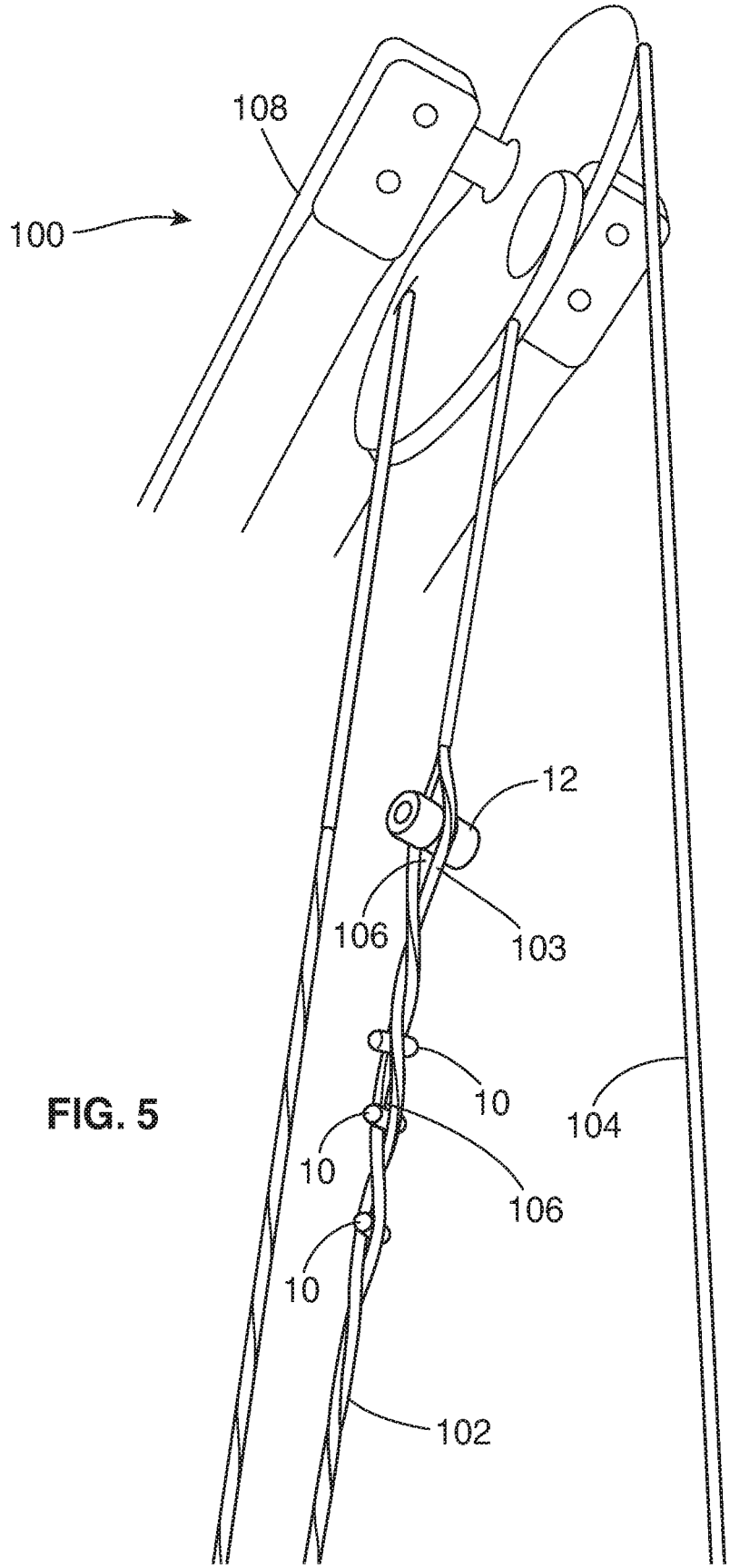
FIG. 5 is a perspective view of three adjustment spacers and one split holder retained in a cable of an archery bow in accordance with the present invention.

With reference to FIGS. 3-4, an adjustment spacer 18 or split holder 20 includes a base plate 22 and a plurality of separation projections 24 extending from one side of the base plate 22. The adjustment spacer 18 or the split holder 20 is being used to create multiple split areas 106 in a cable 102 or a bowstring 104. A shortened length of the cable 102 or bowstring 104 is proportional to a perimeter length of each separation projection 24.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of micro adjusting, cable length, cam timing, or cam orientation on an archery bow, comprising the steps of:

separating filaments of a cable to form a split area; and inserting an adjustment spacer into said split area, said adjustment spacer is retained in said split area by axial tension of said cable, said adjustment spacer is not compressible, said adjustment spacer is not capable of adjustment along a length or width thereof, said adjustment spacer includes a spacer lengthwise axis, said spacer lengthwise axis is perpendicular to a lengthwise axis of said cable, a length of said cable is reduced proportionally to a perimeter of said adjustment spacer.

2. The method of micro adjusting, cable length, cam timing, or cam orientation on an archery bow of claim 1 wherein:

said adjustment spacer includes a base plate and a plurality of separation projections extending from one side of said base plate to create multiple split areas in a cable.

3. A method of micro adjusting, cable length, cam timing, or cam orientation on an archery bow, comprising the steps of:

fabricating a cable with a plurality of filaments; and inserting a split holder or an adjustment spacer between said plurality of filaments during a manufacture thereof, said split holder or adjustment spacer are not compressible, said split holder or adjustment spacer are not capable of adjustment along a length or width thereof, said split holder or adjustment spacer include a first lengthwise axis, said first lengthwise axis is perpendicular to a second lengthwise axis of said cable, said split holder or said adjustment spacer is retained in said split area by axial tension of said cable when said cable is installed in an archery bow.

4. The method of micro adjusting, cable length, cam timing, or cam orientation on an archery bow of claim 3 wherein:

said adjustment spacer or split holder includes a base plate and a plurality of separation projections extending from one side of said base plate to create multiple split areas in a cable.

5. A method of micro adjusting, cable length, cam timing, or cam orientation on an archery bow, comprising the steps of:

separating filaments of a cable to form a split area; and inserting a split holder or an adjustment spacer into said split area, said split holder or said adjustment spacer include a reduced perimeter in a middle of a length thereof, said split holder or adjustment spacer are not capable of adjustment along a length or width thereof, said split holder or adjustment spacer are not compressible, said split holder or adjustment spacer include a first lengthwise axis, said first lengthwise axis is perpendicular to a second lengthwise axis of said cable, said split holder or said adjustment spacer is retained in said split area by axial tension of said cable, a length of said cable does not change when the archery bow is drawn.

6. The method of micro adjusting, cable length, cam timing, or cam orientation on an archery bow of claim 5, further comprising the step of:

moving said split holder along a length of said cable to move said split area.

7. The method of micro adjusting, cable length, cam timing, or cam orientation on an archery bow of claim 5, further comprising the step of:

inserting an adjustment spacer into said split area and removing said split holder.

8. The method of micro adjusting, cable length, cam timing, or cam orientation on an archery bow of claim 5 wherein:

said split holder or said adjustment spacer are retained in said cable by a shape of said split holder or adjustment spacer.

9. The method of micro adjusting, cable length, cam timing, or cam orientation on an archery bow of claim 5 wherein:

said adjustment spacer or split holder includes a base plate and a plurality of separation projections extending from one side of said base plate to create multiple split areas in a cable.

* * * * *